US008517784B1

(12) United States Patent
Bekker et al.

(10) Patent No.: US 8,517,784 B1
(45) Date of Patent: Aug. 27, 2013

(54) SYSTEM FOR LIFTING THRUSTERS FOR PROVIDING MAINTENANCE

(76) Inventors: Joannes Raymond Mari Bekker, Houston, TX (US); Sammy Russell Moore, Houston, TX (US)

( * ) Notice: Subject to any disclaimer, the term of this patent is extended or adjusted under 35 U.S.C. 154(b) by 266 days.

(21) Appl. No.: 13/209,262

(22) Filed: Aug. 12, 2011

Related U.S. Application Data

(60) Provisional application No. 61/383,684, filed on Sep. 16, 2010.

(51) Int. Cl.
*B63H 5/125* (2006.01)

(52) U.S. Cl.
USPC ..... 440/54

(58) Field of Classification Search
USPC ..... 29/402.01, 402.03, 426.1; 440/54, 440/65; 114/264, 265, 268
See application file for complete search history.

(56) References Cited

U.S. PATENT DOCUMENTS

| | | | | |
|---|---|---|---|---|
| 3,483,843 | A * | 12/1969 | Hawthorne | 440/54 |
| 4,436,050 | A | 3/1984 | Liden | |
| 4,580,517 | A | 4/1986 | Lundberg | |
| 4,878,864 | A | 11/1989 | Van Bentem | |
| 5,403,216 | A | 4/1995 | Salmi et al. | |
| 5,491,636 | A | 2/1996 | Robertson et al. | |
| 6,067,697 | A * | 5/2000 | Savikurki et al. | 29/426.1 |
| 6,247,421 | B1 | 6/2001 | Ludwigson | |
| 6,257,165 | B1 | 7/2001 | Danos, Jr. et al. | |
| 6,375,524 | B1 | 4/2002 | Commandeur et al. | |
| 6,378,450 | B1 | 4/2002 | Begnaud et al. | |
| 6,439,936 | B1 * | 8/2002 | Dreith et al. | 440/54 |
| 6,453,838 | B1 | 9/2002 | Mowell et al. | |
| 6,668,746 | B1 | 12/2003 | Schia et al. | |
| 6,672,236 | B1 | 1/2004 | Pinsof | |
| 6,848,380 | B1 | 2/2005 | Sainz | |
| 6,848,382 | B1 | 2/2005 | Bekker | |
| 7,055,447 | B1 | 6/2006 | Bekker | |
| 7,641,526 | B1 * | 1/2010 | Bekker | 440/54 |

* cited by examiner

*Primary Examiner* — Stephen Avila
*Assistant Examiner* — Anthony Wiest

(57) ABSTRACT

A system for lifting thrusters of vessels enabling for maintenance to be safely provided on the thrusters, wherein the system can include a lifting means with a line and a connector to engage thrusters or portions of thrusters. A transport device can be connected to the lifting means for transporting the thrusters or the portions of the thrusters. Clamps can secure thruster mounting flanges to thruster well bottom flanges. A conduit with a controller and a pump can allow water to flow into and out of the thruster wells. Seals adjacent the thruster mounting flanges can provide a connection between the flanges. A plurality of alignment guide plates can be disposed concentrically around the thrusters in the thruster wells and for a rough alignment of the thrusters to the thruster mounting flanges. Fasteners can secure the thruster mounting flanges to the thruster well bottom flanges.

17 Claims, 9 Drawing Sheets

SYSTEM FOR LIFTING THRUSTERS FOR PROVIDING MAINTENANCE

CROSS REFERENCE TO RELATED APPLICATIONS

The current application claims priority to and the benefit of co-pending U.S. Provisional Patent Application Ser. No. 61/383,684 filed on Sep. 16, 2010, entitled "SYSTEM FOR LIFTING THURSTS FOR PROVIDING MAINTENANCE TO THRUSTERS". This application is incorporated in its entirety herewith.

FIELD

The present embodiments generally relate to a system for thruster withdrawal for maintenance or for vessel transit, without the need of an external crane, a remote operated vehicle (ROV), or a diver.

BACKGROUND

A need exists for easily performing major maintenance on thrusters of deep draft vessels, such as drill ships, semi-submersibles, floating production platforms (FPSO), and other vessels because the thrusters extend below the bottom of the hull and are submerged in seawater at all times. Traditionally, maintenance has been performed by one of three ways.

Conventionally, for maintenance, the thrusters have been transported, attached to the vessel, to a dry dock, or to a graving dock. At the dry dock or graving dock, the vessel with the thrusters is taken out of the water. Problems exist with this conventional maintenance method and system because the vessel owners and operators lose vessel operating time as the vessel is out of service, and the use of the graving dock or dry dock is expensive.

The present embodiments provide a lower cost solution to this conventional maintenance system and method.

It has also been known to use divers or remote operated vehicles (ROV) beneath the floating vessel, which can lead to problems, in that the divers or the ROV's drop tools, are clumsy, and parts can be lost overboard. Special training is needed for the divers and for ROV operators.

The present embodiments no longer require the need for divers or ROV's to do underwater maintenance on thrusters.

The present embodiments reduce the risk of the occurrence of accidents that often occur when divers perform underwater maintenance on thrusters by eliminating or reducing the need for the divers.

The present embodiments meet the need.

BRIEF DESCRIPTION OF THE DRAWINGS

The detailed description will be better understood in conjunction with the accompanying drawings as follows.

Figure 1A:
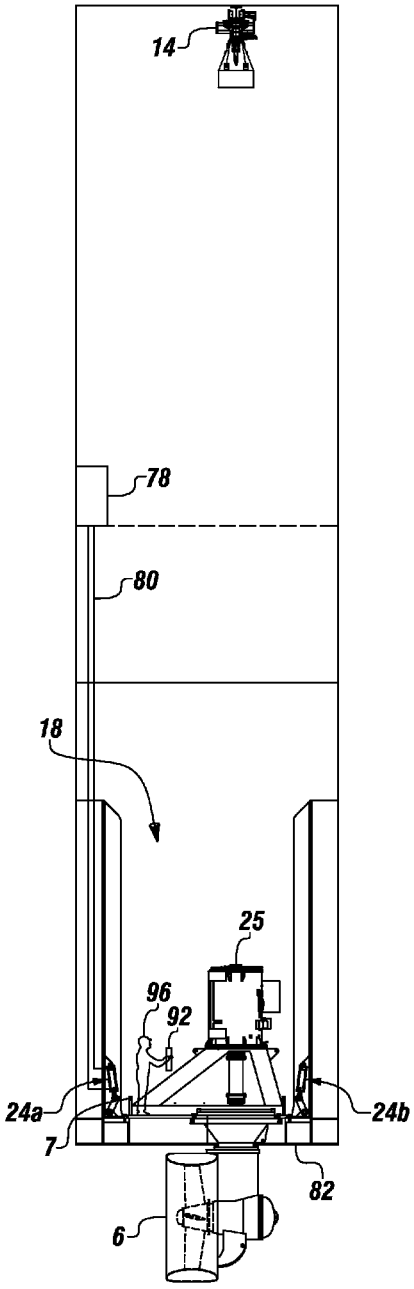
FIG. 1A is a view of equipment used for lifting a thruster at a first stage of operation with a user in the thruster well.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to a system for lifting thrusters from thruster wells while a vessel is floating.

The system for lifting a thruster can use at least one lifting eye. The thruster can be a positioning thruster for a floating vessel. The system can enable major maintenance to be safely provided on the thruster without docking the thruster or vessel, without needing a heavy lift barge or heavy lift vessel, and without the need for divers or ROVs to perform the maintenance.

The system can include a lifting means, such as a bridge crane, a hoist, or a removable lifting means with a flexible lift line. The flexible lift line can be a cable, a rope, or a chain, that can have on one end a connector, such as a hook or a shackle.

The lifting means can allow the connector, engaged to the flexible lift line, to extend into a thruster well, which can be a hollow cylinder that surrounds a thruster.

The thruster well can be made from steel and can have a diameter that extends around a thruster without touching the thruster. The thruster or portions of the thruster can have lifting eyes pre-installed on the thruster or on pieces of equipment associated with the thruster. The thruster well can be cylindrical with a single thruster well wall or it can have another shape with a plurality of thruster well walls. The thruster well can have a thruster well bottom flange.

The lifting means can connect to a movable transport device, such as a movable trolley capable of supporting and moving several tons of equipment, such as by rolling. The lifting means and the movable transport device can transport at least a portion of the thruster, such as the electric motor or a connecting shaft.

A plurality of clamps can be disposed in the thruster well around the thruster. Each clamp can be made from an actuator that can be a hydraulic cylinder, a pneumatic cylinder, a screw jack, or an electrical clamp. The actuator can be adapted to extend and retract. A linkage can connect to the actuator for engagement with one of a plurality of clevises. In embodiments, the clevises can be plates, such as a clevis plate having a four sided polygon shape with a hole. One side of the polygon shaped clevis plate can be secured to an inside surface of the thruster well wall. In one or more embodiments, the clevises can be disposed approximately equidistantly around the inside surface of the thruster well. The clamps can secure a thruster mounting flange to the thruster well bottom flange.

A conduit, such as a thru hull fitting, can be used to controllably allow water, such as sea water or ballast water, into the thruster well. The water flow can be controlled by a controller that can be bidirectional or an inflow controller, such as an inflow valve, a reach rod, or a remote actuatable controller. If an inflow controller is used, an additional outflow controller can also be used. A pump, such as an electric pump, can be used to flow the water out of the thruster well once the maintenance is complete on the thruster and the thruster has been reset into the thruster well. Fresh water from a water reservoir, such as ballast tanks, can be used to supply water to the thruster well for the purpose of equalizing the water pressure in the thruster well with the water pressure outside the floating vessel.

A first seal can be positioned adjacent the thruster mounting flange for providing a water tight connection when compressed using the plurality of clamps. A second seal can be used that can be concentric with the first seal and adjacent the thruster mounting flange, thereby providing a water tight connection between the thruster well bottom flange and the thruster mounting flange.

The system can include a plurality of alignment guide plates, each extending from the bottom of the thruster well to a thruster well wall top. Each of plurality of alignment guide plates can be disposed concentrically around the thruster in the thruster well. With the alignment guide plates extending from the thruster well bottom flange to a thruster well wall top, such as a few feet above the thruster, the alignment guide plates can provide for a rough alignment of the thruster to the thruster mounting flange.

The thruster can be mounted using a plurality of fasteners, which can be unbolted or unfastened to remove the thruster. The fasteners, which can be bolts with nuts, can secure the thruster mounting flange to the thruster well bottom flange.

In one or more embodiments, the system can be used to lift at least one thruster from one thruster well for relocation on a deck using lifting means when the thruster well is flooded with water and the clamps have been released.

One or more embodiments can include a spreader bar with a spreader bar connector or a sling with a sling connector that can be used to lift portions of the thruster that can be adversely affected by water, or to lift the entire thruster. The spreader bar connector or the sling connector can each engage the connector of the lifting means and can also engage at least one lifting eye of the thruster.

Index guides connected to the inside surface of the thruster well wall can be used to guide the thruster into a correct installation position on the thruster well bottom flange. Each index guide can be a portion of a clevis. In one or more embodiments, one of the alignment guides can be an index guide.

In one or more embodiments, if the actuator is a hydraulic cylinder, a rod can be used for engaging the linkage. The actuator, which can be a hydraulic cylinder or a pneumatic cylinder, can use the rod for engaging the linkage.

In one or more embodiments, from about three to about one hundred alignment guide plates can be mounted in each thruster well; from about three to about thirty clamps can be disposed in each thruster well; and from about three to about thirty clevis plates can be installed in each thruster well.

A top cover, such as a round plate, can be used to allow storage of removed thruster components over the thruster well or of other components. A bottom cover can be used to cover an opening formed in the thruster well bottom flange when the thruster is lifted from the thruster well.

In one or more embodiments, a manipulator can be connected to a power source for lifting the thruster and portions of the thruster. The manipulator can also be used to rotate and turn the thruster. The manipulator can slidingly attach to at least one rail that can be mounted to the inside surface of the thruster well wall. Two parallel rails can be affixed to the inside surface of the thruster well wall and can extend from proximate the thruster well bottom flange to the thruster well wall top to move the manipulator.

A hydraulic cylinder can be used as the actuator. A hydraulic power unit can be fluidly connected through a hydraulic feed line to the hydraulic cylinder to provide power.

One or more embodiments can include alignment pins disposed concentrically in the thruster well bottom flange for positioning of the thruster in a fine alignment thereto. The alignment pins can project through holes in the thruster mounting flange providing a "micro" or fine alignment of the thruster to the thruster mounting flange. The micro or fine alignment can be an alignment within less than a few millimeters.

In embodiments, the system can include a pressure washer connected to the conduit for allowing wash down of at least a portion of the thruster.

A power tool can be used, such as a hydraulic tool, a pneumatic tool, or an electric tool, to facilitate a quick install and removal of the fasteners. For example, each fastener can be installed or removed in less than one minute.

The present embodiments relate to a system that enables the lifting of thrusters from a vessel hull while a vessel is floating, such as at sea, for transit of the vessel or for repair of the thrusters away from shore, without needing an external crane, remote operated vehicles, or divers.

One of the benefits of the system can be that the system provides significant safety protection compared to commercial techniques for maintaining thrusters, such as diver dry suits and associated communication apparatus.

Another benefit of the system can be that no external crane such as a heavy lift crane is needed to maintain the thrusters, which can be dangerous when tendered along side a floating vessel in high seas, and can accidently drop the elements they are hoisting into the sea or on people of either vessel. The system can include simple onboard cranes, such as bridge cranes, or simple onboard monorails with connected movable transport devices, to prevent the hazards associated with heavy lift cranes from a tendered barge.

The system can be less expensive than known systems. The system can save a floating vessel owner a daily rate of between $100,000 and $300,000 per day in 2010 US dollars, which is generally the cost of renting a heavy lift crane barge.

The system can provide additional safety features such as redundant sealing of each thruster in a thruster well to the hull. The system can provide a level of increased safety, in that test ports can be used to verify that the seals around each thruster are working. The system can include a plurality of strong holding clamps to prevent mishaps that can occur in using just one clamp. If one clamp fails, the others can hold. At least 20 percent more holding clamps can be used than are necessary to hold the thruster mounting flange to the thruster well bottom flange.

The system can be faster to use than known systems in that the amount of time needed to implement the system can be only a matter of hours rather than longer. Typical system can require three to five days, or even up to a week to be implemented with the floating vessel at sea. Conventionally, a floating vessel with positioning thrusters needs to call for a heavy lift crane barge to drive up to the floating vessel and be tendered next to the floating vessel. The present system does not require a wait time to perform maintenance due to weather that prevents tendering. The system can be quicker than traditional underwater thruster dismount techniques and can require no operator in water training. With use of the system, the thruster can be prevented from falling through an opening into the sea, which can happen, for example, when cranes lift a thruster from its floating vessel, over open water and onto a waiting barge, for transport to land for repair.

The system can require less overall maintenance personnel training on underwater removal systems, so no extra wetsuits or dry suits are needed. This extra equipment can be an added expense, and typically includes custom fitted dry suits, regulators, fins, gloves, and other diver communication equipment which can be expensive.

The system can be more environmentally friendly than known systems, as it does not let a thruster be lost overboard, where it can leak oil into the ocean when a heavy lift crane from a separate vessel is used.

The system can enable an operator of the floating vessel to be independent from outside assistance, even while at sea, the operator can perform needed maintenance without additional assistance.

The thrusters can be configured for removal and re-installation while the floating vessel is at maintenance draft, which can be ten meters lower than normal transit drafts. As such, the system can provide stability compared to removal at the shallower transit drafts and can reduce the hoisting distance.

The lifting means can lift one or more portions of the thruster. The system can include a movable transport device connected to the lifting means. The movable transport device can be a rolling trolley which, in sequence, can pick up and deposit portions of each thruster to a deck of the floating vessel, such as those portions of the thruster that can be adversely affected by water, such as the electric motor and the connecting shaft for the thruster.

In operation, the thruster well bottom flange that can be clamped shut using the clamps. The clamps can be actuated to compress at least one seal between the thruster mounting flange and the thruster well bottom flange. Once the seal is compressed and the plurality of fasteners are removed, water can be flowed into the thruster well to a maintenance level which can be below the thruster well wall top. In embodiments, the thruster well can be filled about 50 percent full in order to equalize pressure around the thruster.

In one or more embodiments, once the thruster well is flooded with water, the thruster can be connected to the connector of the lifting means and the thruster can be raised with the hoist or other lifting means from the thruster well.

For transit of the floating vessel, the lifting means can hold the thruster up and out of the water, and the opening in which the thruster came through can be capped with a bottom cover. The thruster can be lifted and then lowered to a deck for transit, for running, or for being towed. For maintenance of the thruster, once the thruster is lifted, the thruster can be lowered to the deck, which can be adjacent to or in proximity with the thruster well. On the deck the thruster can be serviced and parts can be replaced. The thruster, once serviced, can be lifted from the deck by the lifting means and then lowered into the thruster well. The alignment guides, which can be attached to the inside surface of the thruster well wall, can be used to position the thruster in the thruster well in a proper position on the thruster well bottom flange. The thruster can be positioned off-center from a central axis of the thruster well. The alignment pins can be used to provide fine alignment of the thruster onto the thruster mounting flange. An index guide can also be used to provide fine alignment of the thruster in the thruster well and over the thruster well bottom flange. Once aligned, the system can actuate the plurality of clamps and compress at least one seal, or two concentric seals, to secure the thruster mounting flange against the thruster well bottom flange. After compressing at least one seal, the system can pump out the water in the thruster well. When the thruster well has been drained of water, a human or operator can enter the thruster well, or robot arms can extend into the thruster well, and the plurality of fasteners can be re-installed to hold the thruster mounting flange to the thruster well bottom flange. Once the fasteners are installed, the plurality of clamps can be disengaged and left in an open position. Each index guide can be connected to the inside surface of the thruster well wall to further fit or clock the thruster into a correct orientation on the thruster well bottom flange.

In one or more embodiments, the alignment pins can be tapered.

In one or more embodiments, more clamps can be installed in the thruster well than are needed. Each clamp can be selected to easily sustain the load of two clamps in the event of failure of an adjacent clamp.

In one or more embodiments, clamp style nuts can be used to facilitate rapid fastening and un-fastening of the thruster to the thruster well bottom flange and to minimize the time that operators or workers have to be in the thruster well. A hydraulic power tool can be used with the clamp style nuts for fast removal and reinstall, such as in less than twenty seconds per nut. The hydraulic power tool can be a hydraulic stud tensioner.

In one or more embodiments, the manipulator can clamp onto the thruster and support the thruster as the manipulator moves from a bottom position to a thruster well wall top. The manipulator can be used along the inside surface of the thruster well wall, such as on a pair of rails mounted to the thruster well wall. In one or more embodiments, the manipulator can be a hydraulic carriage with load supporting hinged or pivotable clasping arms. In one or more embodiments, remote controlled robotic arms can be installed on the manipulator to position the thruster for easy maintenance access. The robot arms can be controlled from a wireless remote device connected to a network.

In one or more embodiments, the system can use a hydraulic cylinder or pneumatic cylinder as an actuator, which can have a rod that can slide in and out of the cylinder along a central axis, thereby powering the linkage to compress the seal and seal the thruster mounting flange to the thruster mounting flange. In one or more embodiments the plurality of clamps can be simultaneously engaging clamps.

In one or more embodiments, a second lifting means can be used in combination with the first lifting means, thereby enabling both lifting means to rotate and to position the thruster for easy maintenance access. The second lifting means can be removably installed on the floating vessel.

In one or more embodiments the thrusters can be positioning thrusters.

In one or more embodiments, the alignment guides can be used to position the thruster in the thruster well, and to position the thruster at a location offset from and not in alignment with a central axis of the thruster well.

The system can include an at least partially clad thruster well bottom flange, such as with a cladding over steel, or another corrosion resistant material disposed on the thruster well bottom flange. For example, the cladding can be from about 1/16 of an inch to about 1/4 of an inch in thickness. The cladding can be on a mating surface, that is, clad on the surface that mates with the thruster mounting flange. The thruster mounting flange can be stainless steel, a stiff material, a corrosion resistant material, or combinations thereof. The thruster mounting flange can have a thickness from about ½ of an inch to about 6 inches. The thruster well bottom flange can be clad on the surface that mates with the thruster mounting flange, which can also be clad.

At least one test port can be formed in the thruster mounting flange to provide a means for verifying that a water tight connection exists between the thruster well bottom flange and the thruster mounting flange. Four test ports can be equidistantly disposed around the thruster. The test port can test the first seal, or inner seal, regardless of the presence of multiple seals.

An example of how the system might operate is as follows: form a thruster well in the bottom of a floating vessel around an opening in the bottom of the hull through which a thruster is mounted; optionally clad at least a portion of the thruster well bottom flange; install a plurality of alignment guide plates on an inside surface of the thruster well; optionally, clad the thruster mounting flange on the portions where it mates with the thruster well bottom flange; position at least one seal adjacent the thruster mounting flange; install a plurality of fasteners to secure the thruster mounting flange to the thruster well bottom flange; form a plurality of clevises on an inside surface of the thruster well wall; use clamp style nuts to facilitate rapid fastening and unfastening of the thruster to the thruster well bottom flange; fasten a plurality of clamps around the thruster and to clevises in the thruster well; optionally, use a rod for engaging the linkage; maintain the clamps in an open position; use a lifting means to engage a thruster or a portion of a thruster; optionally, use a spreader bar to engage the thruster; lift portions of the thruster that may be adversely affected by water; transport the lifted thruster or portions of the thruster while lifted to a deck for repair; actuate the plurality of clamps to hold the thruster mounting flange against the thruster well bottom flange to compress the seal; remove the fasteners while the clamps are actuated; remove workers, if any are in the thruster well; flood the thruster well with water; disengage the plurality of clamps; lift the thruster with the lifting means when the thruster well is flooded with water; move the lifted thruster to a deck; after maintenance, position the lifted thruster over the thruster well; lower the thruster into the thruster well using the alignment guides; optionally, further guide the thruster onto the thruster mounting flange using at least one index guide; actuate the plurality of clamps to compress the seal; use alignment pins to provide fine alignment of the thruster onto the thruster mounting flange; pump the water from the thruster well, and allow humans or robots into the thruster well; reinstall the fasteners on the thruster mounting flange to hold it to the thruster well bottom flange with the humans or robots; use at least one test port to verify the water tight connection; if the seal is tight, disengage the clamps; optionally, use a manipulator to raise or lower the thruster while the manipulator is connected to a power supply; optionally use robot arms to raise and lower the thruster; optionally, use a second lifting means to position a thruster while holding the thruster with the first lifting means; place a top cover on the thruster well to provide storage; place a bottom cover over the hole in the thruster well bottom during floating vessel transit to keep water out of the vessel; use the clamps as connected to a power unit; optionally, use a pressure washer to wash down the thruster; and optionally, use a power tool to install and remove the fasteners.

Turning now to the Figures, FIG. 1A depicts a first view of the system used in a first step of a sequence for lifting a thruster 6 with a human 96 in the thruster well 18.

The thruster 6 is shown proximate a vessel hull bottom 82, such as a hull bottom of a floating vessel in the thruster well 18.

A lifting means 14 is shown disposed opposite the thruster 6, which can be an electric, hydraulic, or pneumatic hoist. Also depicted are a lifting eye 7, an electric motor 25 of the thruster 6, a hydraulic power unit 78, a hydraulic feed line 80 in communication with the hydraulic power unit 78, and a clamp 24*a* in communication with the hydraulic feed line 80. For example, the clamp 24*a* can include a hydraulic cylinder in communication with the hydraulic feed line 80. The clamp 24*b* is also shown. The human 96 is shown with a power tool 92. In one or more embodiments, the lifting eye 7 can be welded to the thruster 6 in an L-shaped configuration, with the lifting means 14 securing to one side of the lifting eye 7 for lifting the thruster 6 or portions of the thruster.

Figure 1B:
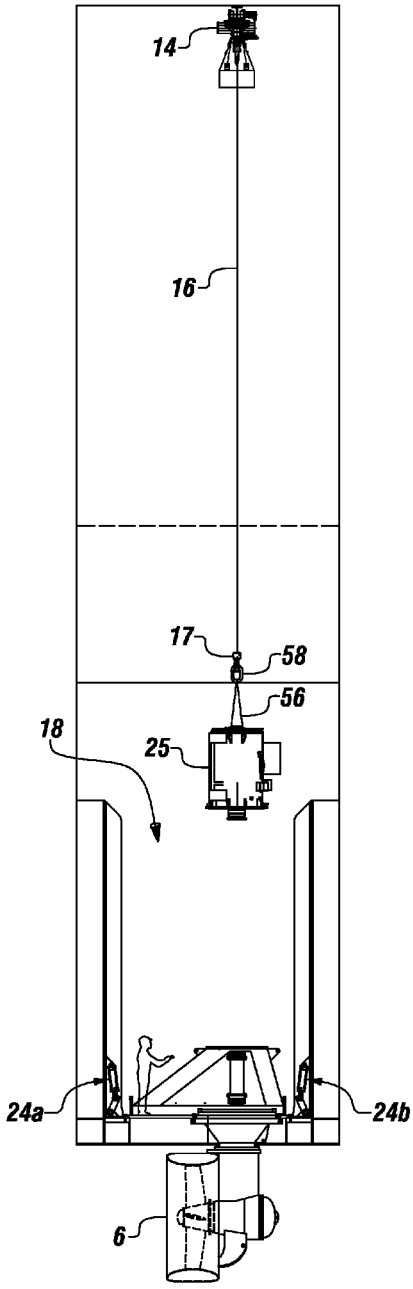
FIG. 1B is a view of equipment used for lifting a thruster at a second stage of operation with an electric motor hoisted out of the thruster well.

FIG. 1B depicts another view of the system showing a second step in the sequence for lifting a portion of the thruster 6. The electric motor 25, which powers the thruster 6, is shown being hoisted out of the thruster well 18.

The lifting means 14 can be connected to a flexible lift line 16, which can be a cable. A connector 17, which can be a hook, can be connected to the flexible lift line 16 opposite the lifting means 14. The connector 17 can also be connected to a sling connector 58 which can be connected to a sling 56. The sling 56 can be connected to the electric motor 25 for lifting the electric motor 25. Also depicted are the clamps 24*a* and 24*b*. During the stage of operation depicted, the thruster well 18 can be devoid of water.

Figure 1C:
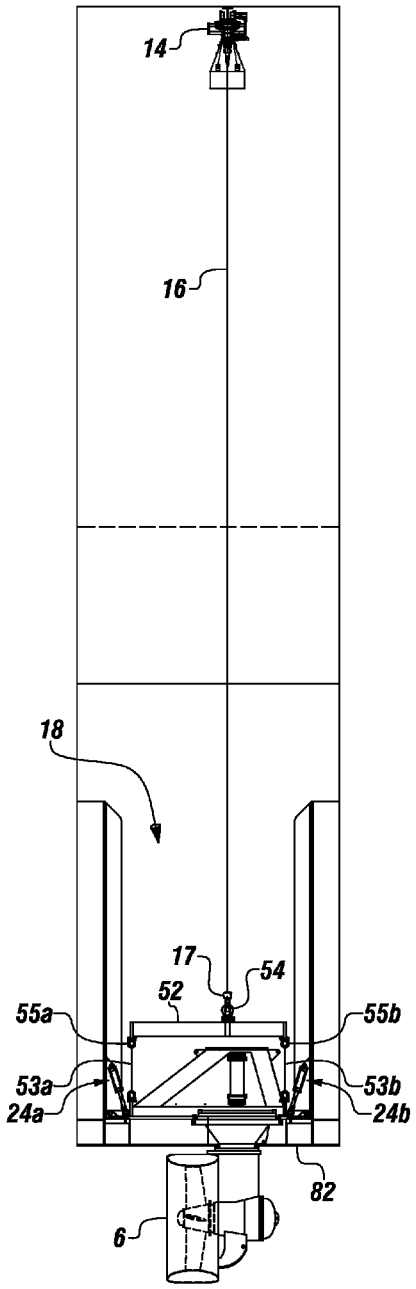
FIG. 1C shows an embodiment of a deployed spreader bar in the thruster well for use in lifting at least a portion of the thruster.

FIG. 1C shows another embodiment of the system depicting a deployed spreader bar 52 with a plurality of flexible members 53*a* and 53*b* in the thruster well 18. Each flexible member 53*a* and 53*b* can be a cable and can have a connection, such as connections 55*a* and 55*b*, which can be shackles for engaging with the thruster 6 or with portions of the thruster in the thruster well 18. The spreader bar 52 can have a spreader bar connector 54 for engaging the connector 17 of the lifting means 14 and the flexible lift line 16. Also depicted are vessel hull bottom 82, and the clamps 24*a* and 24*b* in actuated positions.

Figure 1D:
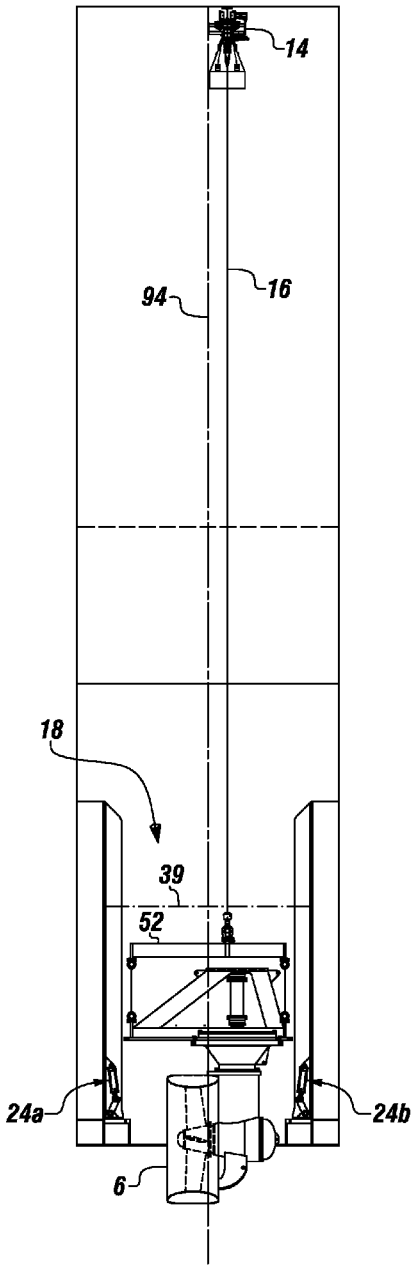
FIG. 1D shows a slightly raised thruster hoisted using the spreader bar, and with the thruster well partially filled with water.

FIG. 1D depicts the thruster well 18 containing water 39. The clamps 24*a* and 24*b* are depicted in non-actuated positions. The lifting means 14 with the flexible lift line 16 has slightly raised the thruster 6 from the thruster well 18 using the spreader bar 52. By having the thruster well 18 at least partially filled with water 39, the pressure on the thruster 6 can be equalized with the water pressure outside of the floating vessel. The thruster 6 can be raised and placed on a deck of the floating vessel. The thruster 6 is depicted mounted off-center of a central axis 94 of the thruster well 18.

Figure 1E:
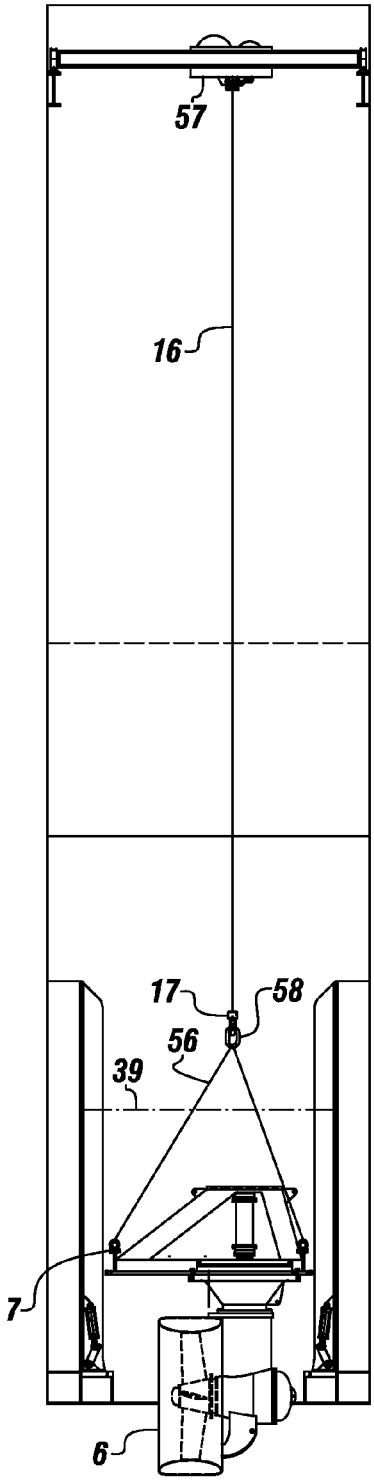
FIG. 1E depicts the system with a bridge crane and sling used for removing the thruster.

FIG. 1E depicts the system with a bridge crane 57 and sling 56 that can be used for removing the thruster 6. Also shown are the flexible lift line 16, the connector 17, the sling connector 58, the water 39, and the lifting eye 7 engaged with the sling 56.

Figure 2B:
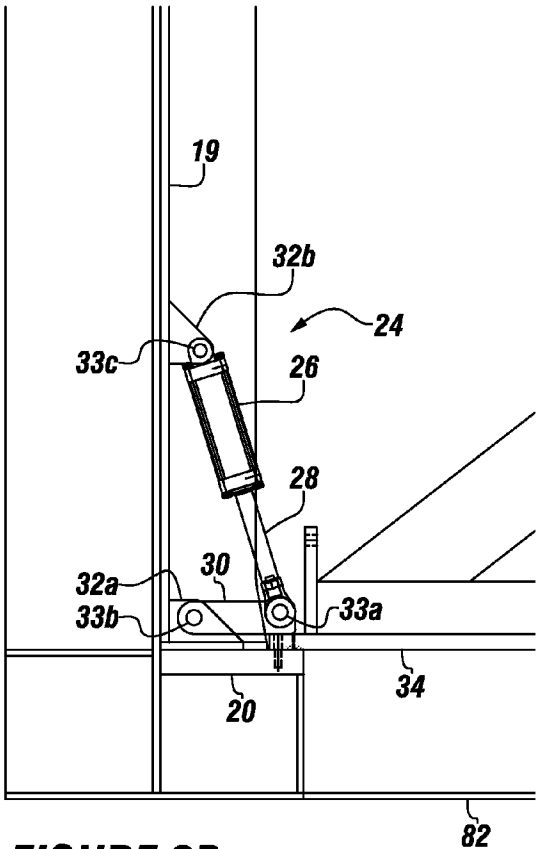
FIGS. 2A-2B depict a detailed view of a clamp used to hold a thruster mounting flange to the thruster well bottom flange in two positions.
Figure 2A:
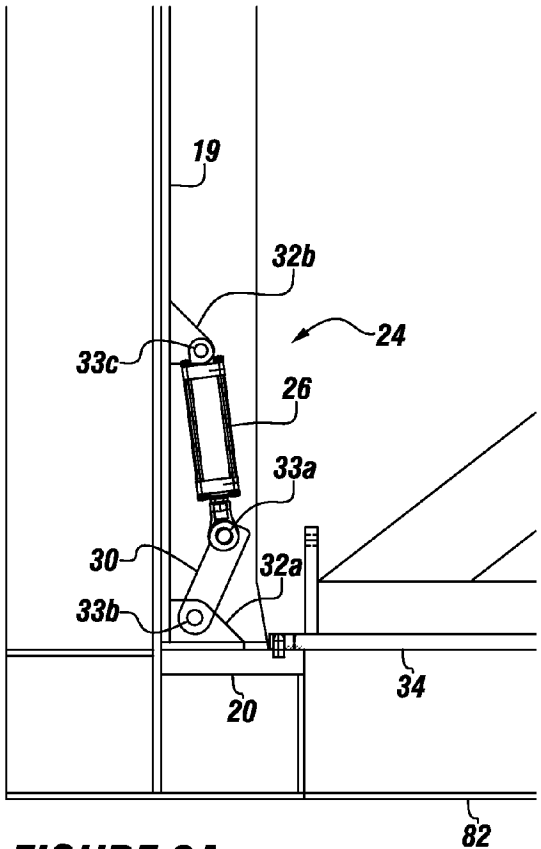

FIGS. 2A and 2B depict a detailed view of a clamp 24 used to hold a thruster mounting flange 34 to a thruster well bottom flange 20 near the vessel hull bottom 82. The clamp 24 is shown in a de-actuated position in FIG. 2A, and in an actuated position in FIG. 2B.

The clamp 24 can include an actuator 26, which can be a hydraulic cylinder, a pneumatic cylinder, a screw jack, or an electrical clamp. The actuator 26 can support a rod 28 that can slidingly engage the actuator 26. The rod 28 can connect to a pivoting linkage 30, such as with a first pin 33*a*. The pivoting linkage 30 can connect to a first clevis 32*a*, which can be connected to the thruster well wall 19. The first clevis 32*a* is shown having a polygon shape with a hole for supporting a second pin 33*b*, which can be a clevis pin that engages the pivoting linkage 30, and allows the pivoting linkage 30 to rotate about the second pin 33*b*. The actuator 26 can be connected to the thruster well wall 19 at a second clevis 32*b* with a third pin 33*c*, which can be a clevis pin.

The actuator 26 can be a cylinder with a piston that moves toward the vessel hull bottom 82 causing the pivoting linkage 30 to secure the thruster mounting flange 34 to the thruster well bottom flange 20.

Figure 3:
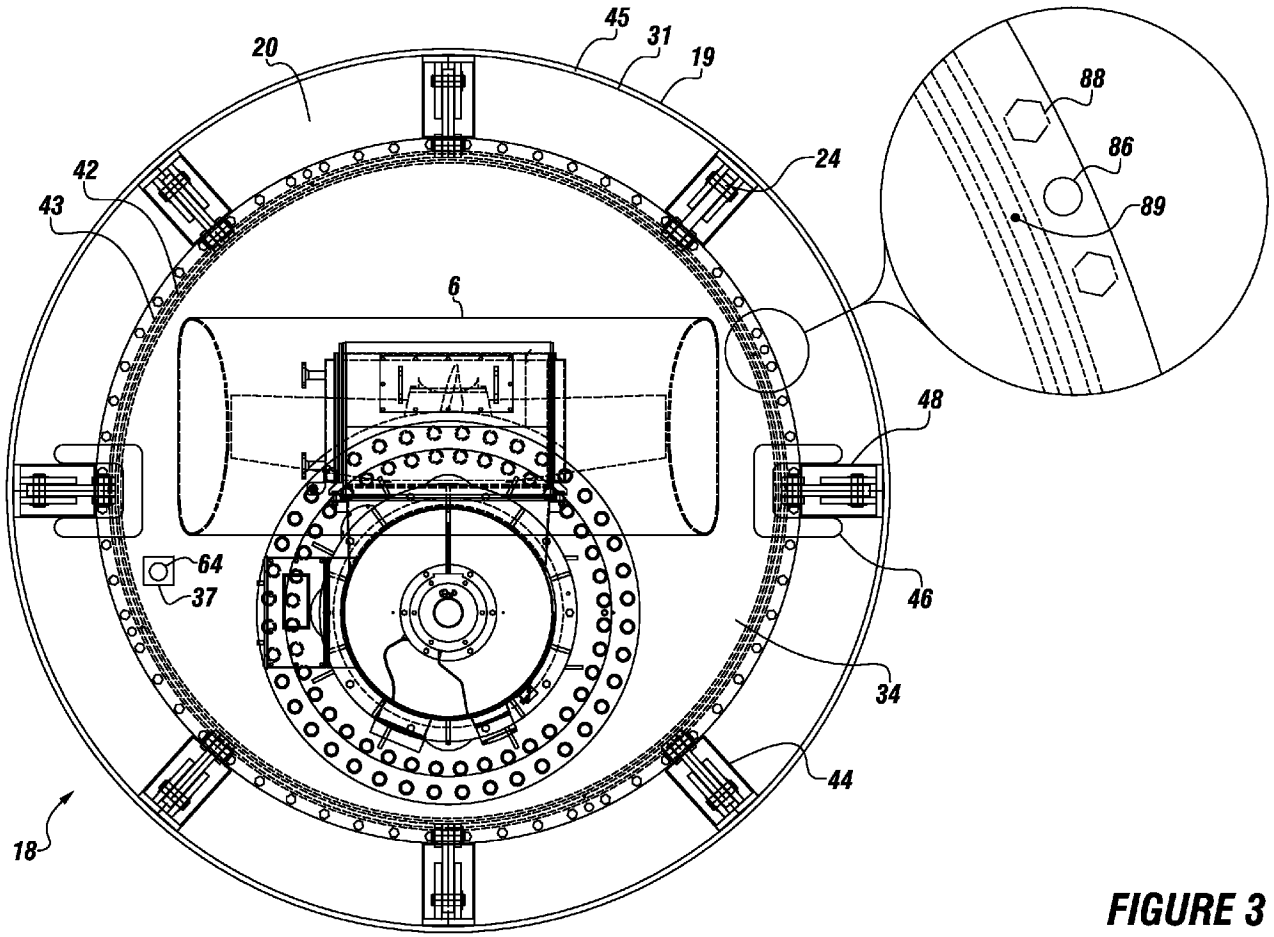
FIG. 3 is a top view of the thruster well with the clamps disposed around a portion of the thruster.

FIG. 3 is a top view of the thruster well 18 with clamps disposed around a top portion of the thruster 6.

The thruster well 18 can be disposed about the thruster 6. The thruster well 18 can have a thruster well wall 19 with a thruster well wall top 45 and a thruster well bottom flange 20. The thruster well wall 19 can have an inside surface 31 to which can be attached a plurality of alignment guide plates, such as alignment guide plate 44.

A thru hull fitting 48 can be used to allow sea water to enter through the vessel hull bottom to the thruster well 18.

The system can include a plurality of test ports, such as test port 89, which can be disposed in the thruster mounting flange 34. A first seal 42 can be positioned adjacent the thruster mounting flange 34, and a second seal 43 can be concentrically disposed around the first seal 42.

A plurality of alignment pins, such as alignment pin 86, can provide for a fine alignment of the thruster 6 in the thruster mounting flange 34. The alignment pins can be cylinders of steel with diameters from about ½ of an inch to about 3 inches. In embodiments, the alignment pins can be tapered on the end opposite the thruster mounting flange 34.

Fasteners, such as fastener 88, can bolt or fasten the thruster mounting flange 34 to the thruster well bottom flange 20.

Index guides, such as index guide 46, can fix rotation of the thruster 6. The index guides can be notches. The index guide 46 can be connected to the inside surface 31 of the thruster well wall 19.

Also shown is this Figure, are the clamp 24, an in-flow controller 37 and an opening 64.

Figure 4:
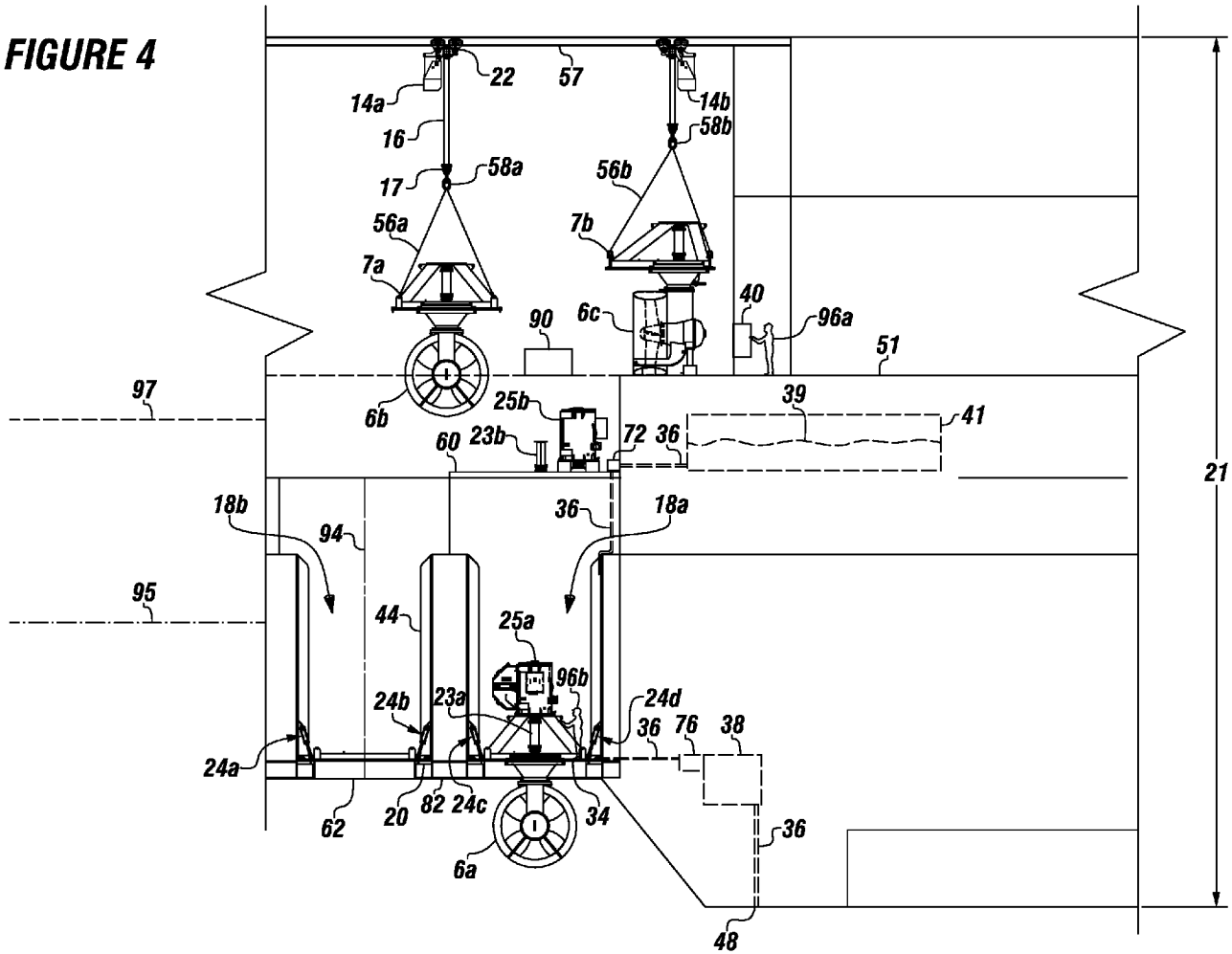
FIG. 4 is a view of three thrusters, one in a thruster well, a second thruster suspended above the thruster well held by a hoist, and a third thruster positioned on deck of a floating vessel for maintenance according to one or more embodiments.

FIG. 4 depicts the system with three thrusters, thruster 6*a*, thruster 6*b*, and thruster 6*c*. Thruster 6*a* is disposed in a thruster well 18*a*. The thruster 6*b* is suspended above the thruster wells 18*a* and 18*b*, and is held by a first lifting means 14*a*. The thruster 6*c* is shown on deck 51 of the floating vessel 21 and engaged with a second lifting means 14*b*.

The first lifting means 14*a* is shown connected to thruster 6*b* and a movable transport device 22 that can roll along a bridge crane 57. The second lifting means 14*b* is also depicted connected to the bridge crane 57. The first lifting means 14*a* can have a flexible lift line 16, a connector 17, a first lifting eye 7*a*, a first sling connector 58*a*, and a first sling 56*a*.

The second lifting means 14*b* is shown connected to thruster 6*c* and can have a second lifting eye 7*b*, a second sling connector 58*b*, and a second sling 56*b*.

A first human 96*a* is shown at a controller 40 for operating a pump 38 connected to a conduit 36. The pump 38 can pump water 39 from a water reservoir 41 through an in-flow valve 72 into the thruster wells 18*a* and 18*b*. An "in-flow" controller and an "out-flow" controller or a bidirectional controller can be used to move the water 39. The pump 38 can be in communication with a remote actuated controller 76. A thru hull fitting 48 can be opened or closed, such as with a valve, to allow sea water to enter the thruster wells. The thru hull fitting 48 can be in fluid communication with the pump 38. In operation, prior to allowing water 39 into the thruster wells, people can be evacuated from the thruster wells. The people can remove the fasteners from the thruster mounting flange after actuating the plurality of clamps.

A top cover 60 is shown mounted above the thruster well 18*a* onto which equipment can be mounted for use in repair of other thrusters 6*a*, 6*b*, and 6*c*, such as a second electric motor 25*b* and a second connecting shaft 23*b* from the second thruster 6*b*.

In one or more embodiments, a remote control device or remote actuated controller can be used to remotely activate and de-activate the clamps 24*a*, 24*b*, 24*c*, and 24*d*.

A pressure washer 90 can be used in the thruster wells to clean salt water off the thrusters.

Also depicted is a second human 96*b*, a first motor 25*a*, a first connecting shaft 23*a*, the central axis 94 of the thruster well 18*b*, a maintenance draught 95, and an operating draught 97. The maintenance draught 95 can be a level at which water is kept during maintenance of the thrusters, and the operating draught 97 can be a level at which water is kept during operations of the thrusters.

Also depicted is the thruster mounting flange 34, a thruster well bottom flange 20, a vessel hull bottom 82, a bottom cover 62, and an alignment guide plate 44.

Figure 5:
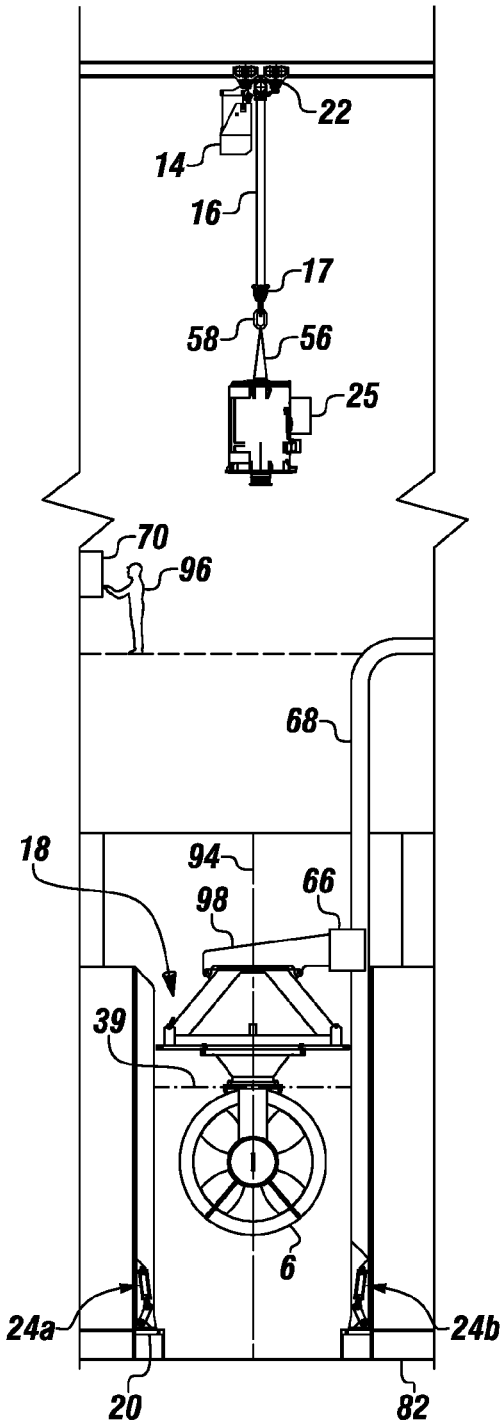
FIG. 5 is a view of a thruster well with a reach rod.

FIG. 5 is a side view of a thruster well 18 with clamps 24*a* and 24*b*, and a thruster 6. A human 96 is shown operating a power source 70.

The thruster well 18 is shown with a manipulator 66 disposed on a rail 68 that enables the manipulator 66 to slide up and down the rail, thereby raising and lowering the thruster 6. The manipulator 66 can have a robot arm 98 for engaging the thruster 6.

Also depicted are the movable transport device 22, the lifting means 14, the flexible lift line 16, the connector 17, the sling connector 58, the sling 56, the electric motor 25, the central axis 94, the water 39, the thruster well bottom flange 20, and the vessel hull bottom 82.

Figure 6A:
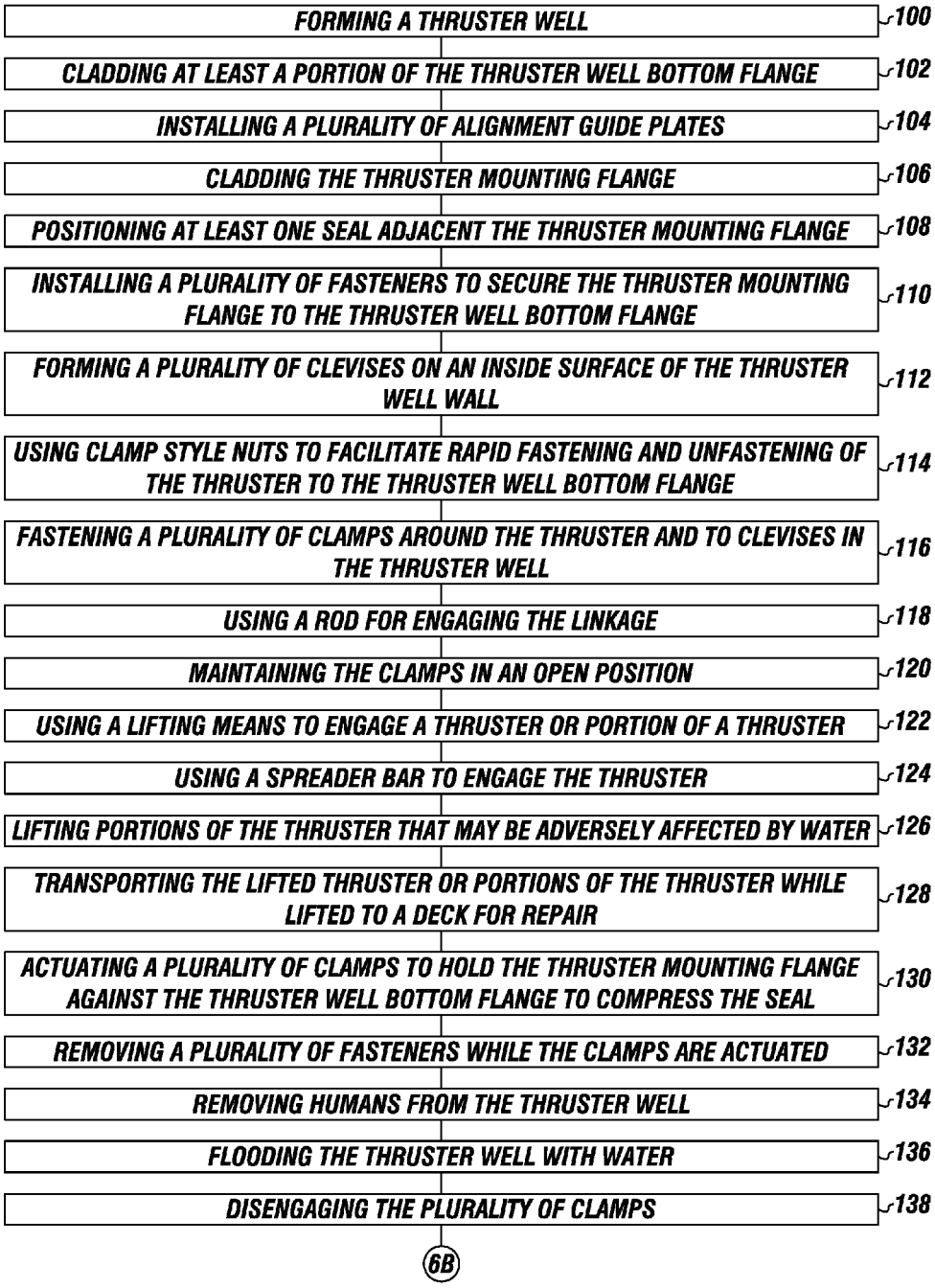
FIGS. 6A-6B depict an embodiment of a method according to one or more embodiments.
Figure 6B:
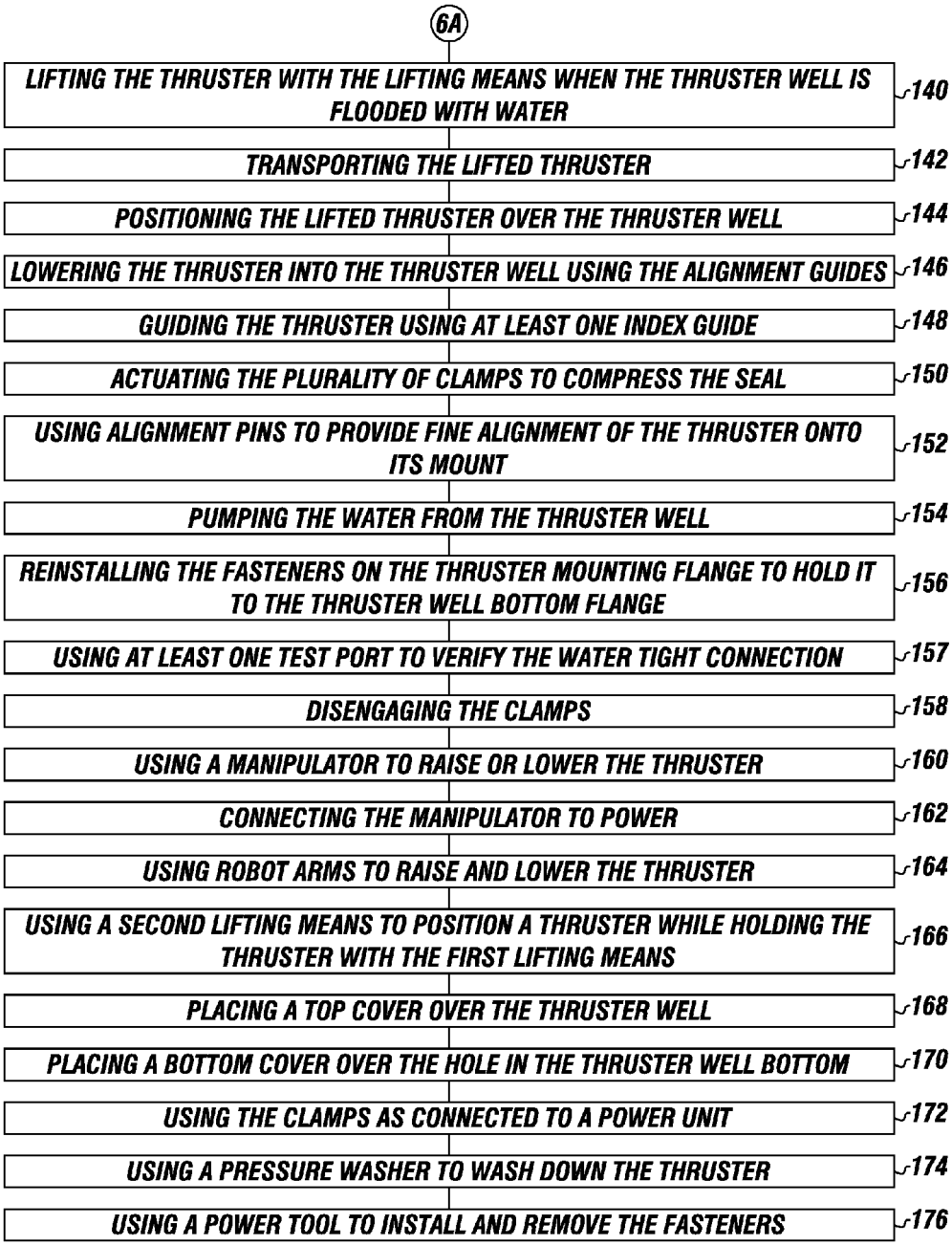

FIGS. 6A-6B depict an embodiment of steps of the method.

FIG. 6A shows that the method can include forming a thruster well, as illustrated by box 100.

The method can include cladding at least a portion of the thruster well bottom flange, as illustrated by box 102.

The method can include installing a plurality of alignment guide plates, as illustrated by box 104.

The method can include cladding the thruster mounting flange, as illustrated by box 106.

The method can include positioning at least one seal adjacent the thruster mounting flange, as illustrated by box 108.

The method can include installing a plurality of fasteners to secure the thruster mounting flange to the thruster well bottom flange, as illustrated by box 110.

The method can include forming a plurality of clevises on an inside surface of the thruster well wall, as illustrated by box 112.

The method can include using clamp style nuts to facilitate rapid fastening and unfastening of the thruster to the thruster well bottom flange, as illustrated by box 114.

The method can include fastening a plurality of clamps around the thruster and to clevises in the thruster well, as illustrated by box 116.

The method can include using a rod for engaging the linkage, as illustrated by box 118.

The method can include maintaining the clamps in an open position, as illustrated by box 120.

The method can include using a lifting means to engage a thruster or portion of a thruster, as illustrated by box 122.

The method can include using a spreader bar to engage the thruster, as illustrated by box 124.

The method can include lifting portions of the thruster that may be adversely affected by water, as illustrated by box 126.

The method can include transporting the lifted thruster or portions of the thruster while lifted to a deck for repair, as illustrated by box 128.

The method can include actuating a plurality of clamps to hold the thruster mounting flange against the thruster well bottom flange to compress the seal, as illustrated by box 130.

The method can include removing a plurality of fasteners while the clamps are actuated, as illustrated by box 132.

The method can include removing humans from the thruster well, as illustrated by box 134.

The method can include flooding the thruster well with water, as illustrated by box 136.

The method can include disengaging the plurality of clamps, as illustrated by box 138.

FIG. 6B is a continuation of FIG. 6A. The method can include lifting the thruster with the lifting means when the thruster well is flooded with water, as illustrated by box 140.

The method can include transporting the lifted thruster, as illustrated by box 142. The thruster can then be maintained and/or repaired.

The method can include positioning the lifted thruster over the thruster well, as illustrated by box 144.

The method can include lowering the thruster into the thruster well using the alignment guides, as illustrated by box 146.

The method can include guiding the thruster using at least one index guide, as illustrated by box 148.

The method can include actuating the plurality of clamps to compress the seal, as illustrated by box 150.

The method can include using alignment pins to provide fine alignment of the thruster onto its mount, as illustrated by box 152.

The method can include pumping the water from the thruster well, as illustrated by box 154.

The method can include reinstalling the fasteners on the thruster mounting flange to hold it to the thruster well bottom flange, as illustrated by box 156.

The method can include using at least one test port to verify the water tight connection, as illustrated by box 157.

The method can include disengaging the clamps, as illustrated by box 158.

The method can include using a manipulator to raise or lower the thruster, as illustrated by box 160.

The method can include connecting the manipulator to power, as illustrated by box 162.

The method can include using robot arms to raise and lower the thruster, as illustrated by box 164.

The method can include using a second lifting means to position a thruster while holding the thruster with the first lifting means, as illustrated by box 166.

The method can include placing a top cover over the thruster well, as illustrated by box 168.

The method can include placing a bottom cover over the hole in the thruster well bottom, as illustrated by box 170.

The method can include using the clamps as connected to a power unit, as illustrated by box 172.

The method can include using a pressure washer to wash down the thruster, as illustrated by box 174.

The method can include using a power tool to install and remove the fasteners, as illustrated by box 176.

While these embodiments have been described with emphasis on the embodiments, it should be understood that within the scope of the appended claims, the embodiments might be practiced other than as specifically described herein.

What is claimed is:

1. A system for lifting thrusters of floating vessels enabling for maintenance to be safely provided on the thrusters, the system comprising:

a. a lifting means with a flexible lift line and a connector for extending into a thruster well formed from a thruster well wall and a thruster well bottom flange of a floating vessel to engage a lifting eye of a thruster or to engage a portion of the thruster;

b. a movable transport device connected to the lifting means for transporting the thruster or the portion of the thruster;

c. a plurality of clamps for securing a thruster mounting flange to the thruster well bottom flange, wherein each clamp comprises: an actuator adapted to extend and retract and a linkage connected to the actuator for engagement with one of a plurality of clevis plates, and wherein each clevis plate is secured to an inside surface of the thruster well wall;

d. a conduit for controllably allowing water to flow into the thruster well;

e. a controller for opening and closing the conduit to allow the water to flow into or out of the thruster well;

f. a pump for pumping the water out of the thruster well;

g. at least one seal adjacent the thruster mounting flange for providing a water tight connection between the thruster well bottom flange and the thruster mounting flange;

h. a plurality of alignment guide plates disposed concentrically around the thruster in the thruster well and extending from proximate the thruster well bottom flange to a thruster well wall top of the thruster well wall for a rough alignment of the thruster to the thruster mounting flange; and i. a plurality of fasteners for securing the thruster mounting flange to the thruster well bottom flange.

2. The system of claim 1, further comprising a spreader bar with a spreader bar connector, wherein the spreader bar connector engages both the connector and at least one lifting eye of the thruster.

3. The system of claim 1, further comprising at least one index guide connected to the inside surface of the thruster well wall to guide the thruster into a correct installation position on the thruster well bottom flange.

4. The system of claim 1, wherein at least one of the plurality of alignment guide plates is additionally an index guide.

5. The system of claim 1, further comprising a rod for engaging the linkage, wherein the actuator is a hydraulic cylinder or a pneumatic cylinder.

6. The system of claim 1, further comprising from three alignment guide plates to one hundred alignment guide plates in the thruster well.

7. The system of claim 1, further comprising from three clamps to thirty clamps.

8. The system of claim 1, further comprising from three clevis plates to thirty clevis plates installed in the thruster well.

9. The system of claim 1, further comprising a top cover for allowing storage of removed thruster components over the thruster well.

10. The system of claim 1, further comprising a bottom cover for covering an opening formed in the thruster well bottom flange when the thruster is lifted from the thruster well.

11. The system of claim 1, further comprising a manipulator connected to a power source for lifting and turning the thruster, wherein the manipulator slidingly attaches to a rail, and wherein the rail is affixed to the inside surface of the thruster well wall and extends from proximate the thruster well bottom flange to the thruster well wall top.

12. The system of claim 1, wherein the actuator comprises a hydraulic cylinder, and wherein the system further comprises: a hydraulic power unit fluidly connected through a hydraulic feed line to the hydraulic cylinder for powering the hydraulic cylinder.

13. The system of claim 1, further comprising a water reservoir to supply the water to the thruster well for equalizing water pressure in the thruster well with water pressure outside of the floating vessel.

14. The system of claim 1, further comprising at least one alignment pin disposed concentrically in the thruster well bottom flange for positioning of the thruster, wherein each alignment pin projects through holes in the thruster mounting flange for a fine alignment of the thruster to the thruster mounting flange.

15. The system of claim 1, further comprising a pressure washer connected to the conduit for allowing wash down of the thruster.

16. The system of claim 1, further comprising a power tool for quickly installing and removing the fasteners.

17. A system for lifting thrusters of floating vessels enabling for maintenance to be safely provided on the thrusters, the system comprising:

a. a lifting means with a lift line and a connector for extending into thruster wells of floating vessels to engage lifting eyes of thrusters or to engage lifting eyes of portions of the thrusters;

b. a transport device connected to the lifting means for transporting the thrusters or the portions of the thrusters;

c. at least one clamp for securing thruster mounting flanges to thruster well bottom flanges, wherein the at least one clamp comprises: an actuator adapted to extend and retract and a linkage connected to the actuator for engagement with at least one clevis plate secured to inside surfaces of thruster wells;

d. a conduit for controllably allowing water to flow into the thruster wells;

e. a controller for opening and closing the conduit to allow the water to flow into or out of the thruster wells;

f. a pump for pumping the water out of the thruster wells;

g. at least one seal adjacent the thruster mounting flanges for providing a sealed connection between the thruster well bottom flanges and the thruster mounting flanges;

h. a plurality of alignment guide plates disposed concentrically around the thrusters in the thruster wells and extending from proximate the thruster well bottom flanges to a thruster well wall top of the thruster well walls for a rough alignment of the thrusters to the thruster mounting flanges; and i. at least one fastener for securing the thruster mounting flanges to the thruster well bottom flanges.

* * * * *